United States Patent [19]

Hannerstig

[11] Patent Number: 5,012,851

[45] Date of Patent: May 7, 1991

[54] HOLDER FOR DRAPING CURTAINS, ARRANGEMENT OF HOLDERS AND PROCESS FOR DRAPING CURTAINS

[75] Inventor: Christer Hannerstig, Höllviksnäs, Sweden

[73] Assignee: AB A. Svensson & Co., Malmö, Sweden

[21] Appl. No.: 416,541

[22] Filed: Oct. 3, 1989

[30] Foreign Application Priority Data

Aug. 16, 1989 [DE] Fed. Rep. of Germany ..... 3927074

[51] Int. Cl.[5] ..... A47H 13/14

[52] U.S. Cl. ..... 160/348; 160/349.2; 248/201

[58] Field of Search ..... 248/201, 220.2, 261, 248/262, 301, 303, 304, 251, 252; 160/348, 349.1, 349.2

[56] References Cited

U.S. PATENT DOCUMENTS

| | | | |
|---|---|---|---|
| 464,499 | 12/1891 | Grenelle . | |
| 744,691 | 11/1903 | Porter | 248/262 |
| 827,000 | 7/1906 | Dinsmore . | |
| 851,678 | 4/1907 | Levy . | |
| 1,730,979 | 10/1929 | Liebchen | 160/348.2 X |
| 1,817,962 | 8/1931 | Breuer . | |
| 1,836,018 | 12/1931 | Dover | 160/349.2 X |
| 1,980,918 | 11/1934 | Hudspeth | 160/349.2 X |
| 2,244,129 | 6/1941 | Stratton . | |
| 2,431,934 | 12/1947 | Higgins | 160/349.2 |
| 2,480,360 | 8/1949 | Doty | 248/252 |
| 2,588,246 | 3/1952 | Kenney . | |
| 2,606,733 | 8/1952 | Krajewski | 160/348 X |
| 2,607,412 | 8/1952 | Vance et al. | 160/348 |
| 3,104,086 | 9/1963 | Salzmann | 248/262 |
| 3,203,469 | 8/1965 | Falkenberg | 160/340 |
| 3,317,167 | 5/1967 | Becker et al. | 248/301 X |
| 3,417,807 | 12/1968 | Falkenberg . | |
| 3,545,523 | 12/1970 | Falkenberg | 160/348 |
| 3,901,303 | 8/1975 | Falkenberg | 160/348 |
| 4,284,258 | 8/1981 | Kleiman | 248/251 |

FOREIGN PATENT DOCUMENTS 0449312 9/1927 Fed. Rep. of Germany .

*Primary Examiner*—Ramon O. Ramirez

[57] ABSTRACT

The invention relates to a holder for draping curtains and for fastening to a wall. The draping of relatively large amounts of curtain material for decorating door or window openings requires much experience. A visually attractive hang of the folds is particularly difficult. To simplify the draping procedure, a holder is provided with at least two recesses in the form of two U sections in each of which parts of the curtain material can be laid.

23 Claims, 3 Drawing Sheets

HOLDER FOR DRAPING CURTAINS, ARRANGEMENT OF HOLDERS AND PROCESS FOR DRAPING CURTAINS

BACKGROUND OF THE INVENTION

Field of the Invention

The invention relates to a holder for draping curtains and for fastening to a wall or the like, and to an arrangement of at least two holders arranged horizontally spaced from one another for draping curtains. Furthermore, the invention relates to a process for draping curtains.

Description of Background Art

Draping of a curtain around window or door openings is carried out for decorative purposes or for covering particular surface regions. The achievement of a particularly attractive visual impression depends chiefly on the successful arrangement of folds or individual webs within the curtain. Usually, the curtain material is folded together to give a bar-like bundle (zigzag fold or alternating fold) and laid over two holders arranged horizontally spaced above the window or the door. Then, the curtain is drawn apart in certain regions depending on the visual impression to be achieved. As a rule, a so-called draping curve is produced between the two holders in which the lower part of the curtain material is drawn downwards to form arcuate folds. Production of a regular and visually attractive hang of the folds is difficult and requires much experience. This is particularly true for relatively large bundles of curtain mate-

SUMMARY AND OBJECTS OF THE INVENTION

The object of the holder according to the invention and the arrangement according to the invention is to enable draping of curtain material to be carried out as simply and rapidly as possible. It is accordingly the object of the process according to the invention to find as rapid and simple a manner as possible to drape a curtain in a visually attractive manner.

The holder according to the invention achieves the object in that at least one, preferably at least two recesses are provided for the curtain material to be positioned. The recess(es) according to the invention produce(s) a particular hang of the folds simply by laying the curtain material in the holder or its recess(es). Subsequent additional drawing of the folds is considerably simplified.

Preferably, the holder is characterized in that it is constructed in the form of a hook fastenable to the wall and distanced therefrom, having U-shaped sections, extending substantially in a plane and connected to one another, the (rear) U section near the wall defining a rear recess and the (front) U section remote from the wall defining a front recess. Bundles of curtain materials laid in such a holder advantangeously lie one behind the other, so that one bundle can at the same time form a visual frame for the other bundle.

The arrangement according to the invention achieves the object in corresponding manner in that the holders each have at least one but preferably a plurality of recesses, depressions or the like. In particular, very wide or a plurality of curtain bundles may thus be draped simply and rapidly. This naturally also applies to individual curtain bundles of conventional width. In all cases, a precise and attractive hang of the folds is achievable.

The process according to the invention for draping curtains is particularly suitable when using at least two holders or an arrangement of holders. Here, the curtain material is laid together in particular in zigzag or alternating folds to give a bar-like bundle. In accordance with the invention, one bundle is then laid in the recesses (U sections) so that a slack part results between the holders and bundle parts each hang down on the outside. With the arrangement of at least two recesses per holder, a further bundle is subsequently laid in similar manner in the respectively second recesses (U sections), this, for example, front bundle not covering or only partially covering the rear bundle. The said bundles may in this case each be part of the same curtain or may be folded together from different curtains, for example curtains of different colours. Depending on the effect which is to be achieved, it is also possible first to lay the bundle in the front recesses.

Advantageous embodiments of the holder according to the invention are provided by using the arrangement and the process according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
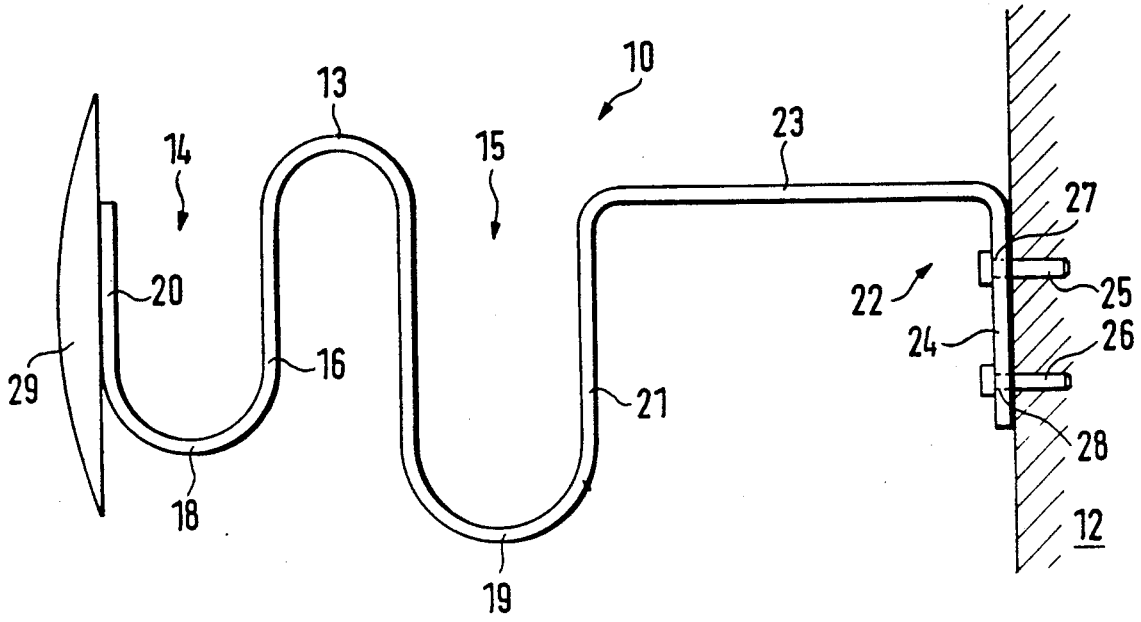
FIG. 1 shows a holder according to the invention in side view, fastened to a wall.

A holder 10 according to the invention for draping curtains 11 is provided for fastening to a wall 12. FIG. 1 shows the holder 10 without curtain. The holder 10 exhibits, in side view, two U sections 14, 15 connected to one another by an upper bend 13. A leg 16 near the wall, of the U section 14 remote from the wall, merges with the upper bend 13 and thereafter with a leg 17 remote from the wall, of the U section 15 near the wall.

The lower regions of the U sections 14, 15 are each designated lower bends 18 and 19. A leg 20 is disposed remote from the wall and is connected to the lower bend 18 of the U section 14 remote from the wall. A leg 21 near the wall is correspondingly provided as a continuation of the lower bend 19. The leg 21 merges with an angle piece 22, namely a horizontal transverse web 23. Connected to this is a vertical upright web 24 which has bores 27, 28 for fastening to the wall 12 by means of screws 25, 26.

A cover in the form of a rose 29 is provided on the free leg 20 remote from the wall, of the U section 14 remote from the wall. This rose is approximately circular and is arranged almost parallel to the leg 20, and serves as a decorative cover for the holder 10 and, as a continuation of the leg 20 upwards, at the same time also serves as a lateral delimitation for a curtain 11 laid in the holder 10.

The holder 10 is preferably shaped out of a flat strip, for example steel of rectangular cross-section. It is also possible to produce it as a casting from castable material. The cross-section of a modified version can be seen particularly clearly in FIGS. 3 and 4.

Figure 5:
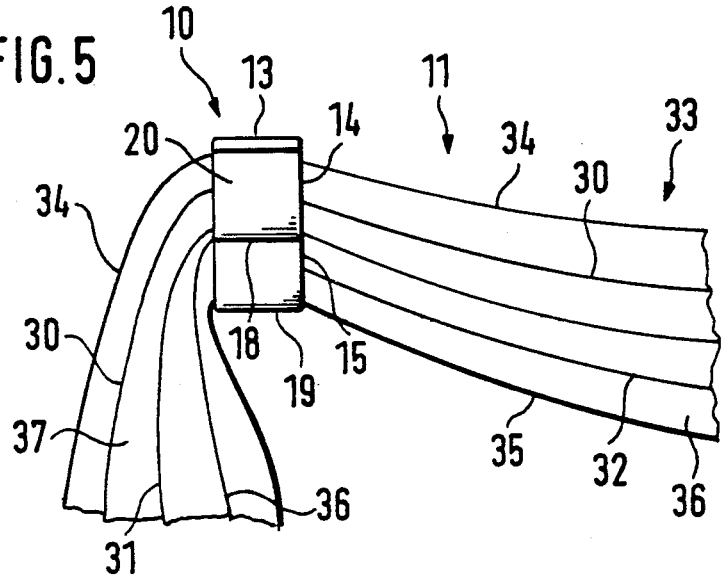
FIG. 5 shows a holder according to the invention, in accordance with FIG. 1, with curtain bundles laid in (without rose)

In FIG. 1 it can be seen that the lower bend 19 near the wall reaches further down than the lower bend 18 remote from the wall. For further clarification, the reader is referred to FIG. 5. The holder 10 shown there is pictured without a rose 29. Otherwise, this would obscure the view of the details which are important in this connection. The curtain 11 is provided to frame a window or door opening. To this end, a total of two holders, namely a respective left and right holder, are arranged above the opening. FIG. 5 shows the left-hand holder. The curtain 11 laid in the holder 10 falls freely downwards on the left-hand side of the holder 10. On the right-hand side of the holder 10 the curtain 11 extends as far as the right-hand holder (not shown in FIG. 5) and further down from this in the direction of the floor. The curtain 11 is folded together to give a bar-like bundle (zigzag fold or alternating fold) and, thus bundled, is laid in the holder 10. The purpose of this is to achieve a visually particularly attractive hang of the folds. In accordance with FIG. 5 part of the folded curtain material is laid in the front U section 14 facing the observer and remote from the wall, and a further part is laid in the rear U section 15 near the wall. The folds 30, 31, 32 produced by the bundling are shown in FIG. 5 as thin lines. A particularly wide draping curve 33 of the curtain 11 results on the right-hand side of the holder 10 because of the differing height of the lower bends 18, 19. The term "width" relates to the spacing between an upper edge 34 and a lower edge 35 of the curtain 11. A similar effect is also achievable with lower bends 18, 19 which end at approximately the same level, in that the lower curtain bundle 36 (edge 35) is drawn from the holder 10 further into the draping curve 33. The construction of the holder 10 with two U sections means that a particular hang of the folds is already defined when the curtain 11 is laid on them, whereas the differing arrangement with respect to the height of the lower bends 18, 19 makes further manual arrangement later of the hang of the folds substantially superfluous.

Also advantageous is the use of separate curtain parts, one curtain part being laid respectively in one U section. This is particularly helpful if different colours are to be worked with.

Figure 2:
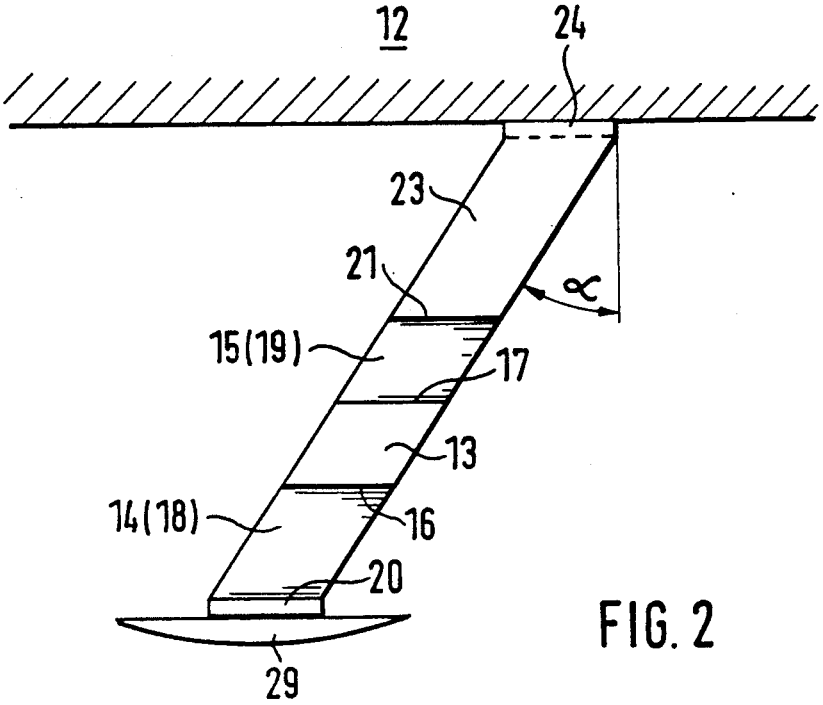
FIG. 2 shows a modified embodiment of the holder of FIG. 1, as seen from above.

FIG. 2 shows a further embodiment of the holder 10, as seen from above. The difference is as follows:

In FIG. 1, the holder 10 extends substantially in a plane projecting from the wall plane and perpendicular to the latter and preferably vertical. In FIG. 2, the holder 10 is arranged to be angled off (angle $\alpha$). The U sections 14, 15 and the transverse web 23 extend in a vertical plane projecting from the wall plane and at the same time angled at an angle of approximately 30° with respect to a vertical plane perpendicular to the wall plane. The upper bend 13 is aligned respectively with the U sections 14, 15. Arranged parallel to the wall are the upright web 24, the legs 21, 17, 16, 20 and the rose 29.

Figure 3:
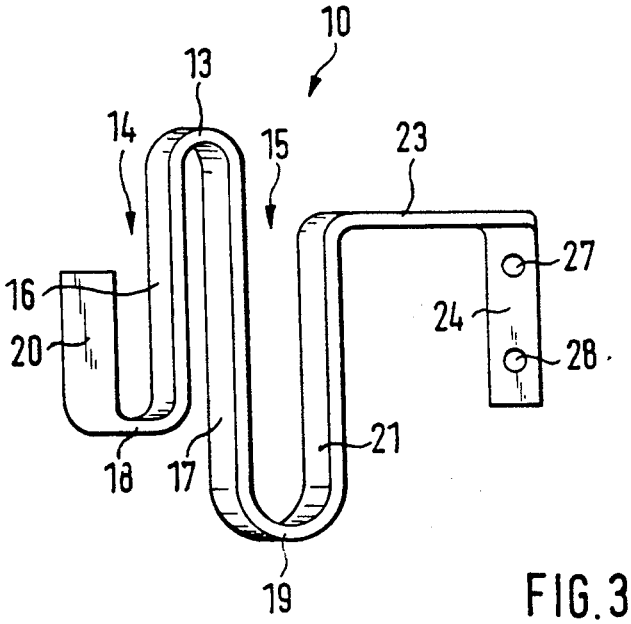
FIG. 3 shows a modified version of the holder of FIG. 2 in a perspective side view (without rose)

The holder 10 of FIG. 3 is angled off in similar manner. There, only the upright web 24 and the leg 20 most remote from the wall are arranged parallel to the wall 12, while the legs 16, 17, 21 are not angled with respect to the lower bends 18, 19 and the upper bend 13.

Figure 6:
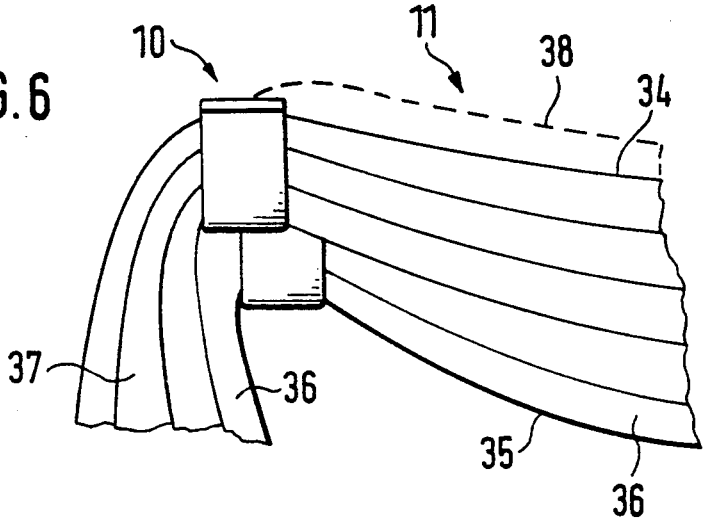
FIG. 6 shows a holder according to the invention, in accordance with FIG. 2, with curtain bundles laid in (without rose)

FIG. 6 shows the particular advantages of the embodiment of FIGS. 2 and 3. In FIG. 6 too, the lower bend 19 near the wall is lower than the lower bend 18 remote from the wall. In accordance with this, a visible division of the curtain with corresponding hang of folds and corresponding width between the edges 34 and 35 results simply by laying the curtain 11 in the holder 10. Because of the angling off by the angle $\alpha$ of approximately 30°, described above, a similar effect is achieved on the left-hand side of the holder 10. The curtain reaching down to the floor (not shown) appears in FIG. 6 as substantially wider than in FIG. 5. The lower curtain bundle 36 is substantially wider in FIG. 6 on the left of the holder 10 than in FIG. 5 because the front upper curtain bundle 37 in FIG. 6 covers a much smaller part than in FIG. 5.

In FIG. 6, the dotted line 38 indicates a further curtain bundle which is additionally laid in the U section 15 near the wall, on the lower curtain bundle 36. This is either a third of a relatively large curtain or a further, third curtain, for example of a different colour.

For the secure receiving of a curtain or of a curtain bundle of the curtain 11, the upper bend 13 is higher than the transverse web 23. Advantageously, the legs 16 and 21 are of the same length. Where the leg 20 does not reach the height of the upper bend 13, the rose 29 extends at least up to this height. The rose 29 is connected to the leg 20 by gluing, riveting or the like.

Figure 4:
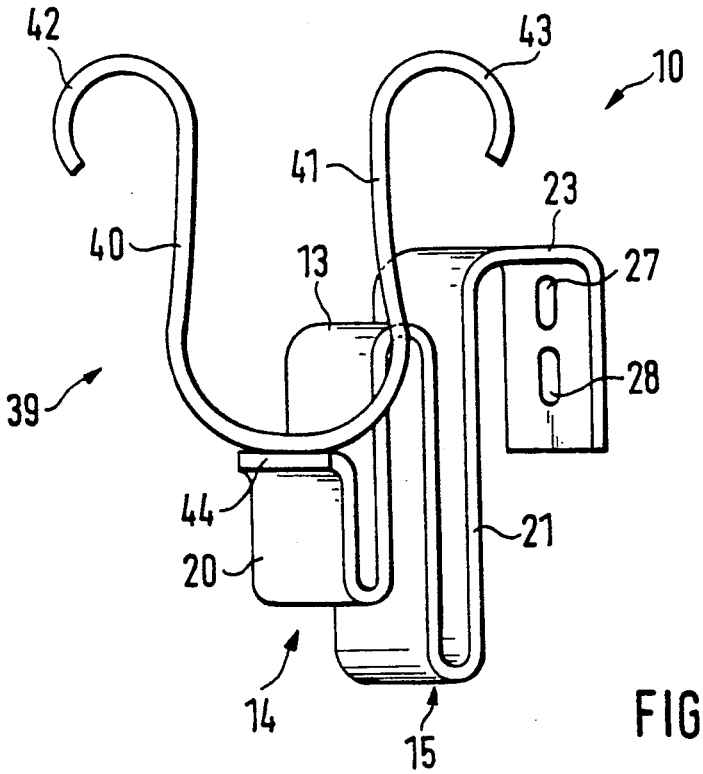
FIG. 4 shows another embodiment of the holder according to the invention with an end piece of particular shape and U sections which are arranged in a particular way relative to one another.

FIG. 4 shows a further embodiment of the holder 10 according to the invention. Instead of a rose, a special end piece 39 is provided. This comprises a flat strip of metal or the like, bent into an approximate U shape. The individual legs 40, 41 are bendable apart resiliently and each bent outwards at their upper ends 42, 43. The legs 40, 41 extend in a plane approximately parallel to the wall surface. The end piece 39 is welded, glued, riveted, soldered or the like to the leg 20 in the region of an L-shaped angling off 44 of the leg 20. Part of the curtain material of the curtain 11 laid in the holder 10 as in FIG. 4 is drawn through between the two legs 40, 41 and draped in a visually attractive manner such that the holder 10 is concealed as far as possible.

FIG. 4 shows a further feature. This is that the upper bend 13 is provided to be lower there than the transverse web 23, in contrast to FIG. 3. This is particularly advantageous if less curtain material is laid in the U section 14 remote from the wall than in the U section 15 near the wall. The bores 27, 28 are constructed as elongate holes in FIG. 4, for a simple height adjustment of the holder 10.

The holder of FIG. 4 can, like the holders of FIGS. 1, 2 and 3, either be arranged or constructed to be angled off or not angled off. The angling off is here always directed outwards, that is to say turned away from the door to window opening.

It is expedient for the draping of a door or window opening always to use an arrangement of holders, namely a total of two holders 10 each with a plurality of recesses (U sections 14, 15). Where angled-off holders 10 are provided, the U sections remote from the wall are turned away from one another and the U sections near the wall each face one another.

As already described above, the curtain material is laid together to give a bar-like bundle. When using a single-piece curtain, the latter is laid in the holders 10 complete, one half respectively coming to lie in one of the U sections 14, 15. When using two separate curtain parts, first one is laid in the respectively rear U sections 15 so that a slack part (draping curve 33) is produced between the holders and curtain parts each hang down on the outside. Then, a curtain part is laid in the respectively front U sections 14 in the same manner, this front curtain part (curtain bundle 37) not covering or only partially covering the rear curtain part (curtain bundle 36). The sequence of laying in the individual curtain parts may also be reversed.

The separate U sections 14, 15 mean that a particular hang of the folds is previously determined, or that separate curtain parts can be draped distinctly divided from one another. The draping procedure as a whole is more rapid and substantially simplified.

Figure 7:
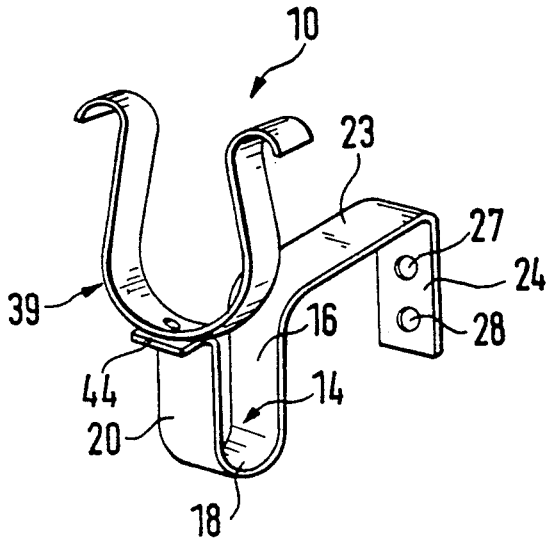
FIG. 7 shows a holder with only one recess in perspective view.

The advantages can also be achieved with holders 10 which, in accordance with FIG. 7, each only have a single recess 14, open to the top in the assembled state, preferably directly behind or connected to the rose 29 or—as illustrated in FIG. 7—behind the C-shaped end piece 39.

All the features disclosed are claimed both individually and also in combination with one another as essential to the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A holder comprising four parallel legs and three U-shaped members connecting ends of the parallel legs, said U-shaped members facing each other in alternating directions to form an "S" which continues to form a reverse "S" to form a front and rear recess for supporting a curtain material, which recesses when said holder is attached to a wall, open upward with the U-shaped member forming the rear recess being closer to the wall and extending deeper than the U-shaped member that forms the front recess, said holder being constructed so that said parallel legs are oriented parallel to a wall when the holder is mounted to a wall; and means for attaching the holder to a wall comprising a transverse member attached at one end to the leg of the deeper extending recess furthest from the other three legs and being extended at a 90° angle from said furthest leg and extending to form a vertical member parallel to the legs, said vertical member providing the means for attaching the holder to a wall.

2. The holder of claim 1 further comprising an outer limiting means positioned on the leg that forms the front recess furthest from the other three legs, said outer limiting means being in a plane parallel to the legs, said outer limiting means serving to hold the curtain forming material within the recess and to cover the legs of the holder from sight.

3. The holder of claim 1 further comprising a lip attached to the leg of the front recess furthest from the other three legs and extending at a 90° angle from said furthest leg;

and an end piece attached to said lip, said end piece having a C-shaped member positioned between and joining two prongs termnating in a curved surface portion at an upper end thereof; the entire structure of the end piece being such that when the holder is attached to the wall, the plane of the prongs of the end piece is oriented parallel to a wall and the end piece is at a distance from the wall, said end piece being capable of receivng a portion of curtain forming material to form a fabric design to conceal the holder.

4. An assembly for draping curtain material comprising:

two holders for holding and draping at least one curtain forming material when the two holders are mounted to a wall and at least one curtain forming material is suspended between the two, each holder having four parallel legs and three U-shaped members connecting the ends of the parallel legs, said U-shaped members facing each other in alternating directions to form an "S" which continues to form a reverse "S" to form front and rear recesses which recesses, when the holders are attached to a wall open upward with the U-shaped members forming the rear recess being closer to the wall and extending deeper than the U-shaped member that forms the front recess, said holder being constructed so that said parallel legs are oriented parallel to a wall when the holder is mounted to a wall;

a means for attaching the holder to an upright wall, comprising a transverse member attached at one end to the leg of the deeper extending recess furthest from the other three legs and extending at a 90° angle from said furthest leg and extending to form a vertical member parallel to the legs, said vertical member providing the means for attaching the holder to a wall;

said holders being capable of supporting at least one curtain forming material when mounted to an upright wall, such that at least one curtain forming material can be plaited to form a bar-like bundle, and be placed in the front and rear recesses in such a way that the curtain forming material is retained while draping arcs are formed between the two holders.

5. The assembly of claim 4 wherein the U-shaped members, the transverse member, and the vertical member of each holder member extend substantially in a plane perpendicular to the wall when the holders are mounted to a wall.

6. The assembly of claim 4 wherein the U-shaped members are arranged laterally offset with respect to one another when the holders are mounted to a wall.

7. The assembly of claim 6 wherein the U-shaped members and the transverse members of each holder extend in a vertical plane which projects from the wall at an angle of 15° to 45° with respect to a vertical plane perpendicular to the plane defined by a wall when the holders are mounted to a wall.

8. The assembly of claim 4 wherein the U-shaped member of each holder positioned between the front and rear recesses extends at least as high as the transverse member when the holders are attached to a wall.

9. The assembly of claim 4 wherein the front and rear recesses of each holder are arranged laterally offset with respect to one another such that when the holders are mounted on a wall the front recesses are further apart from one another than the rear recesses.

10. The assembly of claim 4 further comprising an outer limiting means positioned on the leg that forms the front recess furthest from the other three legs, said outer limiting means being in a plane parallel to the legs, said outer limiting means serving to hold the curtain forming material within the recess and to cover the legs of the holder from sight.

11. The assembly of claim 10 wherein an outer edge of the outer limiting means extends at least as deep as the lower most portion of the U-shaped member that forms the rear recess.

12. The assembly of claim 10 wherein an outer edge of the outer limiting means extends at least as high as the upper most portion of the U-shaped member positioned between the front and rear recess.

13. The assembly of claim 10 wherein the outer limiting means is disc shaped.

14. The assembly for draping curtain material of claim 4 further comprising a lip on each holder attached to the leg of the front recess furthest from the other three legs and extending at a 90° angle from said furthest leg and an end piece attached to said lip, each end piece having a C-shaped member positioned between and joining two prongs terminating in a curved surface portion at an upper end thereof, such that when the holders are mounted to a wall, the plane of the prongs of the end pieces are oriented parallel to the wall and the end pieces are at a distance from the wall, such that a portion of the curtain forming material can be pulled through the prongs of the end piece to form a fabric design.

15. A holder comprising two parallel legs, a U-shaped member connecting the ends of the parallel legs to form a recess, a lip attached to an end of one of the parallel legs extending at an angle of 90° and from said leg, a means for attaching the holder to a wall, said means comprising a transverse member attached at one end to a parallel leg other than the parallel leg to which said lip is attached and extending at a 90° angle from said leg and further extending to form a vertical member parallel to the legs, said vertical member providing the means for attaching the holder to a wall; and an end piece comprising a C-shaped member positioned between and joining two prongs terminating in a curved surface portion at an upper end thereof, the C-shaped member being affixed to the lip, said holder being constructed so that said parallel legs are oriented parallel to a wall and the plane of the prongs extends parallel to a wall when the holder is mounted to a wall.

16. An assembly for draping curtain forming material comprising:

two holders for holding and draping a curtain forming material when the two holders are mounted to a wall and a curtain forming material is suspended between the two, each holder comprising parallel legs, a U-shaped member connecting the ends of the parallel legs to form a recess, a lip attached to an end of one of the parallel legs extending at an angle of 90° from said leg, means for attaching the holder to a wall, said means comprising a transverse member attached at one end to a parallel leg other than the parallel leg to which said lip is attached and extending at a 90° angle from said leg and further extending to form a vertical member parallel to the legs, said vertical member providing the means for attaching the holder to a wall;

an end piece comprising a C-shaped member positioned between and joining two prongs terminating in a curved surface portion at an upper end thereof, the C-shaped member being affixed to the lip, said holder being constructed so that said parallel legs are oriented parallel to a wall and the plane of the prongs extends parallel to a wall when the holder is mounted to a wall; and said holders being capable of supporting curtain forming material when mounted to an upright wall, such that curtain forming material can be plaited to form a bar-like bundle and be placed over the holders in such a way that curtain forming material is retained while a draping arc is formed between the two holders and can be pulled through the prongs of the end piece to form a decorative design at the end piece to cover the holder.

17. A method for draping a curtain forming material comprising the steps of:

attaching two holders to an upright wall, each holder having four parallel legs and three U-shaped members connecting the ends of the parallel legs, said U-shaped members facing each other in alternating directions to form an "S" which continues to form a reverse "S" to form front and rear recesses, and a means for attaching the holder to a wall comprising a transverse member attached at one end to the leg of the rear recess furthest from the other legs and extending at a 90° angle from said furthest leg and extending to form a vertical member parallel to the legs, said vertical member providing the means for attaching the holder to a wall, such that when the holders are mounted to a wall the front and rear recesses open upward, with the U-shaped member forming the rear recess being closer to the wall and extending deeper than the U-shaped member that forms the front recess;

plaiting a curtain forming material into a bar-like bundle, placing a portion of the bundle over the U-shaped member of the rear recess of each holder and placing the remaining portion of the bundle over the U-shaped member of the front recess of each holder in such a way that the curtain forming material is retained while a draping arc is formed between the two holders with the bundle in the front recess covering from view no more than a portion of the bundle in the rear recess.

18. A method for draping a curtain forming material comprising the steps of:

attaching two holders to an upright wall, each holder having four parallel legs and three U-shaped members connecting the ends of the parallel legs, said U-shaped members facing each other in alternating directions for form an "S" which continues to form a reverse "S" to form front and rear recesss, and a means for attaching the holder to a wall comprising a transverse member attached at one end to the leg of the rear recess furthest from the other legs and being extending at a 90° angle from said furthest leg and extending to form a vertical member parallel to the legs, said vertical member providing the means for attaching the holder to a wall, in such a way that when the holders are mounted to a wall the front and rear recesses open upward, with the U-shaped member forming the rear recess being closer to a wall and extending deeper than the U-shaped member that forms the front recess;

plaiting a curtain forming material into a bar-like bundle;

placing the bar-like bundle over the U-shaped member of the rear recesses of the holders to form a draping arc;

plaiting a second curtain forming material into a second bar-like bundle;

placing the second bar-like bundle over the U-shaped member of the front recess in such a way that the curtain material is retained while a draping arc is formed between the two holders with the bundle in the front recess covering from view no more than a portion of the bundle in the rear recess.

19. The method for draping a curtain forming material of claim 18 further comprising the steps of:

plaiting third curtain forming material into a third bar-like bundle, placing the bundle in the rear recesses of the holders in such a way that a draping arc is formed between the holders and the bundles in the rear recess are no more than partially concealed from view by the bundle in the front recess.

20. A method for draping a curtain forming material comprising the steps of:

attaching two holders to an upright wall each holder having four parallel legs and three U-shaped members connecting the ends of the parallel legs, said U-shaped members facing each other in alternating directions to form an "S" which continues to form a reverse "S" to form front and rear recesses, a lip attached to the leg of the front recess furthest from the other three legs and extending at a 90° angle from said furthest leg, an end piece attached to the lip having a C-shaped member positioned between and joining two prongs terminating in a curved surface portion at an upper end thereof, and means for attaching the holder to a wall comprising a transverse member attached at one end to the leg of the rear recess furthest from the other legs and extending at a 90° angle from said furthest leg and extending to form a vertical member parallel to the legs, said vertical member providing the means for attaching the holder to a wall such that when the holders are attached to the wall, the front and rear recesses open upwardly with the rear recess being closer to the wall and extending deeper than the U-shaped member that forms the front recess, the parallel legs are parallel to the wall and the plane of the prongs of the end pieces are oriented parallel to a wall and the end pieces are at a distance from the wall;

plaiting a curtain forming material into a bar-like bundle;

placing a portion of the bundle over the U-shaped member of the rear recess of the holders and placing the remaining portion of the bundle in the front recess of the holder in such a way that the curtain forming material is retained while draping arcs are formed between the two holders;

pulling a portion of the curtain material through the prongs of the end pieces to provide a visually attractive design and to conceal the holders.

21. A method for draping curtain forming material comprising the steps of:

attaching two holders at an upright wall each holder having four parallel legs and three U-shaped members connecting the ends of the parallel legs, said U-shaped members facing each other in alternating directions to form an "S" which continues to form a reverse "S" to form front and rear recesses, a lip attached to the leg of the front recess furthest from the other three legs and extending at a 90° angle from said furthest leg, an end piece attached to the lip having a C-shaped member positioned between and joining two prongs terminating in a curved surface portion at an upper end thereof, and means for attaching the holder to a wall comprising a transverse member attached at one end to the leg of the rear recess furthest from the other legs and extending at a 90° angle from said furthest leg and extending to form a vertical member parallel to the legs, said vertical member providing the means for attaching the holder to a wall such that when the holders are attached to the wall, the front and rear recesses open upwardly with the rear recess being closer to the wall and extending deeper than the U-shaped member that forms the front recess, the parallel legs are parallel to the wall and the plane of the prongs of the end pieces are oriented parallel to a wall and the end pieces are at a distance from the wall;

plaiting a curtain forming material into a bar-like bundle;

placing the bar-like bundle over the U-shaped member of the rear recesses of the holders to form a draping arc;

plaiting a second curtain forming material into a second bar-like bundle;

placing the second bar-like bundle over the U-shaped member of the front recess in such a way that the second bundle does not cover from view more than a portion of the bundle in the rear recesses; and pulling a portion of the curtain forming material through the prongs of the end pieces to provide visually attractive designs on each holder and to conceal the holders.

22. A method for draping a curtain forming material of claim 21 further comprising the steps of:

plaiting a third curtain forming material into a third bar-like bundle, placing the bundle in the rear recesses of the holders in such a way that a draping arc is formed between the holders and the bundles in the rear recesses are no more than partially concealed from view by the bundle in the front recess.

23. A method for draping a curtain forming material comprising the steps of:

attaching two holders to an upright wall, each holder having two parallel legs, a U-shaped member connecting the ends of the legs to form a recess and a lip attached to an end of a parallel leg extending at an angle of 90° from said leg;

a means for attaching the holder to a wall comprising a transverse member attached at one end to a parallel leg other than the parallel leg to which the lip is attached and further extending at a 90° angle from said leg and extending to form a vertical member parallel to the legs, said vertical member providing the means for attaching the holders to a wall; and an end piece attached to the lip comprising a C-shaped member positioned between and joining two prongs terminating in a curved surface portion at an upper end thereof, the entire end piece being attached to the holder in such a way that the prongs of the end piece extend in a plane parallel to the wall;

plaiting a curtain forming material into a bar-like bundle;

placing the bar-like bundle over the U-shaped member of the recesses of the holders to support the curtain material and form a draping arc;

pulling a portion of the curtain forming material forward through the prongs of the end pieces to form fabric designs and to conceal the holders.

* * * * *